United States Patent [19]

Köhn

[11] Patent Number: 4,920,607

[45] Date of Patent: May 1, 1990

[54] ARRANGEMENT IN A VACUUM CLEANER

[75] Inventor: Siegfried W. Köhn, Malmö, Sweden

[73] Assignee: Aktiebolaget Electrolux, Stockholm, Sweden

[21] Appl. No.: 53,852

[22] PCT Filed: Oct. 1, 1986

[86] PCT No.: PCT/SE86/00438

§ 371 Date: May 4, 1987

§ 102(e) Date: May 4, 1987

[87] PCT Pub. No.: WO87/01921

PCT Pub. Date:. Apr. 9, 1987

[30] Foreign Application Priority Data

Oct. 4, 1985 [SE] Sweden ..... 8504598

[51] Int. Cl.[5] ..... A47L 9/28

[52] U.S. Cl. ..... 15/339; 15/319; 15/412

[58] Field of Search ..... 15/319, 339, 412; 318/345 D, 345 G, 345 H, 484

[56] References Cited

U.S. PATENT DOCUMENTS

| | | | |
|---|---|---|---|
| 3,579,706 | 5/1971 | Hetland | 15/412 |
| 4,245,370 | 1/1981 | Baker | 15/319 |
| 4,357,729 | 11/1982 | Vandermolen et al. | 15/319 |
| 4,370,690 | 1/1983 | Baker | 15/319 |
| 4,514,874 | 5/1985 | Kurz | 15/339 |
| 4,615,070 | 10/1986 | Frederick et al. | 15/339 |

FOREIGN PATENT DOCUMENTS

| | | | |
|---|---|---|---|
| 2644697 | 4/1978 | Fed. Rep. of Germany | 15/412 |
| 3225463 | 1/1984 | Fed. Rep. of Germany | 15/319 |
| 132175 | 11/1978 | Japan | 15/412 |

*Primary Examiner*—Philip R. Coe
*Assistant Examiner*—Corinne M. Reinckens
*Attorney, Agent, or Firm*—Pearne, Gordon, McCoy & Granger

[57] ABSTRACT

An arrangement in a vacuum cleaner having an electric motor (15) and a suction fan (14) connected with the motor, the motor being provided with an electronic speed control device (16) making possible the adjustment of the suction power of the vacuum cleaner. The speed control device (16) is arranged by operating of a control means (19; 47) during a predetermined time to control the motor (15) to rotate at a speed corresponding to a power level exceeding the maximum continously available power and then to reconnect the speed that previously prevailed. Means (40, 43, 44, 45) are arranged to prevent operation at the speed corresponding to the exceeding power during a second predetermined time following the first predetermined time.

7 Claims, 2 Drawing Sheets

ARRANGEMENT IN A VACUUM CLEANER

The present invention relates to an arrangement in a vacuum cleaner.

In a vacuum cleaner having an electronic speed control, varying of the speed of the vacuum cleaner motor renders it possible to set the suction power within wide limits according to need. Such a setting may take place in an automatic way considering various parameters such as the degree of filling of the dust container of the vacuum clearner and the nature of the surface to be cleaned. The setting can also be made manually by operation of a control means, e.g. a knob located on the vacuum cleaner and connected to a potentiometer.

Often, modern vacuum cleaners are equipped with strong motors rated at 1000 watts or more and these work satisfactory under most conditions. However, there are cases where a temporary increase in the suction power may be needed, e.g. for removed threads and hair stuck in a wall-to-wall carpet. One way would be to provide the vacuum cleaner with a stronger suction unit. However, this solution results in the vacuum cleaner being overpowered for most of the normal cases of operation. In addition to increase in costs at the power rates concerned this overpowering results in increased temperature levels which may involve cooling problems.

The object of the invention is to remedy the disadvantages referred to and to provide a vacuum cleaner in which it is possible to temporarily obtain increased suction power without the need for dimensioning of the vacuum cleaner for continuous output at the enhanced power corresponding to the increased suction power.

The invention will now be described in detail in connection with an embodiment with reference to the enclosed drawings in which FIG. 1 schematically shows a vacuum cleaner provided with an electronic speed control device.

Figure 1:
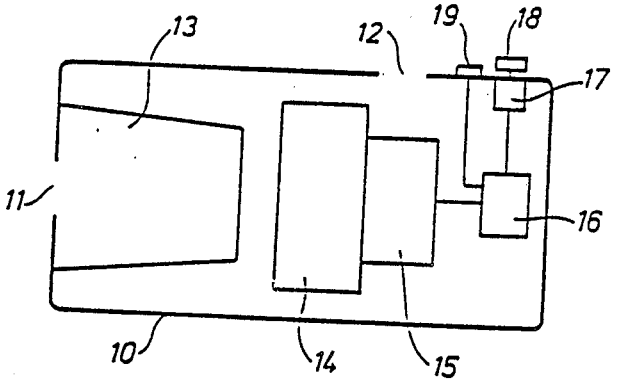

FIG. 1 shows schematically the construction of a common domestic vacuum cleaner. An inlet opening 11 and an outlet opening 12 are provided in a casing 10. A dust container 13 is connected to the inlet opening. For the generation of the suction air stream a suction fan 14 is provided which is driven by an electric motor 15. The motor is controlled by an electronic control device 16. In order to set a motor speed corresponding to the desired suction power, a potentiometer 17 connected to the control device can be operated by a knob 18. Speeds may be selected by the potentiometer within a range limited at its upper end by a speed that corresponds to the maximum power for continuous operation The control device can be operated a push-button switch 19 to increase the motor speed to a level corresponding to a power level exceeding the maximum power for continuous operation.

The higher, exceeding motor power canot be made available for more than a given time without an unallowable rise in temperature levels. Therefore, the higher power output must be limited in time and in the example described the time has been chosen to be 10 seconds. Further, in order to give the motor and the surrounding parts an opportunity to cool the higher power level must not be switched in again until after a predetermined recovery time, in the example 20 seconds.

Figure 2:
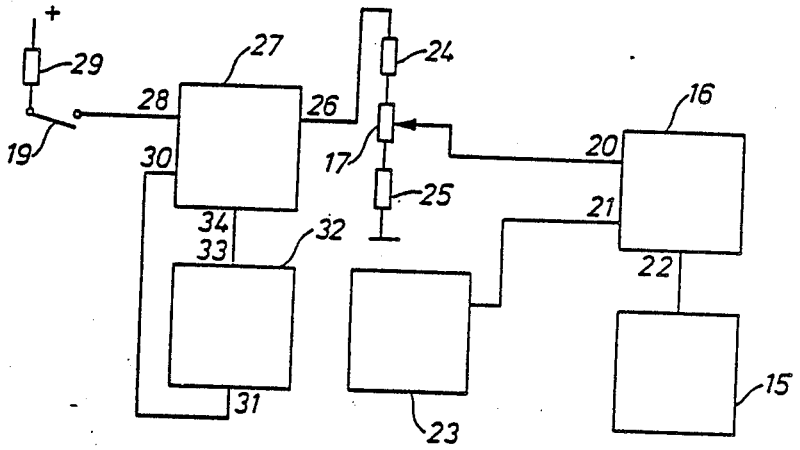
FIG. 2 is a block diagram of the electric and electronic functional blocks included in the vacuum cleaner.

FIG. 2 is a block-diagram of a circuit which makes it possible to switch the higher power in and out in the way described. For that purpose the electronic control device 16 has two inputs 20,21 and one output 22 which connect the control device to the motor 15. To the input 21 there is connected a device 23 which continuously emits a control signal, in the following referred to as the second control signal, which operates the control device 16 to drive the motor at the speed corresponding to the higher power. The movable contact of the potentiometer 17 is connected to the input 20 while the fixed terminals of the potentiometer are connected via resistors 24,25 to a first input 26 of a logical circuit 27 and to earth, respectively. The circuit 27 has a first input 28 which is connected via the switch 19 and a resistor 29 to a positive supply voltage. A second input 30 of the circuit 27 is connected to an output 31 of a counter 32 having an input 33 connected to a second output 34 of the circuit 27.

The arrangement of FIG. 2 functions in the following way. When the vacuum cleaner is to be used within the predetermined speed range up to the maximum continuously available power, the output 26 of the logical circuit 27 is high. This means that a voltage will appear at the input 20 of the control device 16. The voltage can be adjusted by use of the potentiometer 17 in order for the desired speed to be achieved. The control device is designed such that the first control signal at the input 20 dominates over the second control signal at the input 21.

Now, if one desires to temporarily increase the suction power, the push-button switch 19 is operated so that the input 28 of the logical circuit 27 goes high. This results in its output 26 going low so that also the input 20 of the control device 16 will take a low level. Upon the input 20 going low the second control signal at the input 21 of the control device will have the possibility to operate the control device to control the motor to the increased speed. At the same time, at its output 34 the logical circuit 27 emits a signal which starts the counter 32. After the elapse of the predetermined time the counter emits a signal at the output 31 to control the logical circuit to again establish a high level at the output 26. Below, with reference to FIG. 3 it will be described how to prevent the increased speed from being reconnected before the elapse of a second predetermined time.

Figure 3:
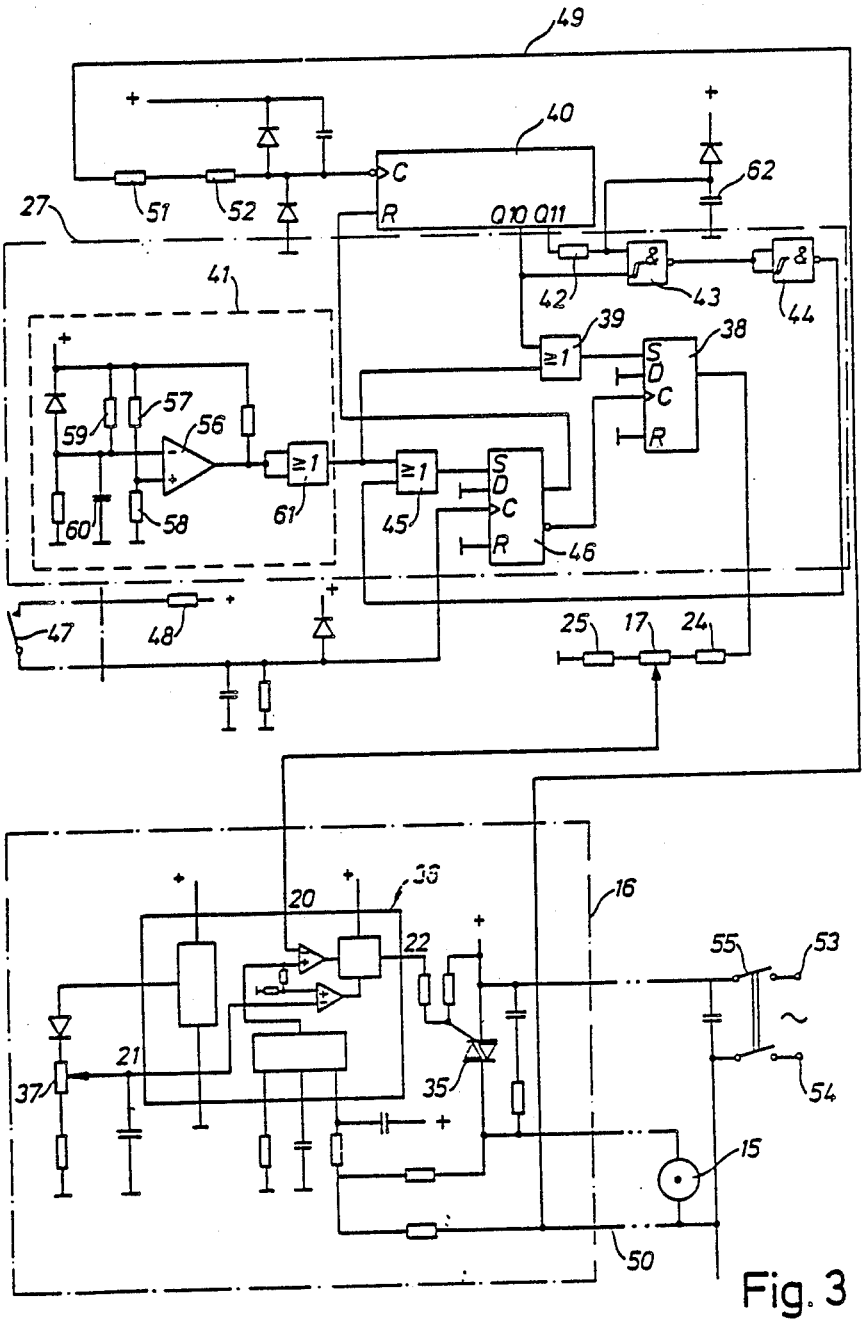
FIG. 3 is a more detailed wiring diagram of the functional blocks essential for the invention and shown in FIG. 2.

A practical wiring for realizing the invention is shown in FIG. 3. The motor 15 is controlled by the electronic control device 16 which essentially comprises an electronic switch 35 such as a triac and a trigger circuit 36 for the switch. The trigger circuit is a commercially available integrated circuit of the type TLE 3101 (Siemens). A detailed description of the integrated circuit as well as a general description of the wiring of the control circuit 16 are given in publicly available data sheets and will not be discussed in this disclosure. The schematic set-up of the circuit 36 is shown by functional blocks, and, in addition, certain external circuit components are disclosed. These blocks and components will not be commented on other than to the extent required for the understanding of the invention.

As in FIG. 2 the inputs for the first and the second control signal have been designated 20 and 21, respectively. Moreover, the output is denoted by 22 and trigger signals are applied to the switch 35 from this output. The circuit 36 itself generates a reference voltage which can be set by a potentiometer 37 to a value which permits the full excursion of the switch 35 so that the motor will be driven at the increased speed. By means included in the circuit 36 it will be ensured that the second control signal is blocked as long as the first control signal has a positive value exceeding a predetermined level. The second control signal is permitted to act only when the control signal is zero.

The logical circuit 27 in FIG. 2 can be realized by the coupling shown in block 27 in FIG. 3. The output 26 of circuit 27 is a non-inverting output of a flip-flop 38, the output being connected to the series coupling comprising the resistors 24 and 25 and the potentiometer 17, also shown in FIG. 2. The SET-input of flip-flop 38 is connected to the output of an OR-gate 39. The input of the gate is connected to an output Q 10 of a counter 40. The other input of gate 39 is connected to a device 41, called "autoset", the function of which will be described more in detail below.

The counter 40 has another output Q 11 which is connected via a resistor 42 to an input of an inverting AND-gate 43, the other input of which is connected to the output Q 10 of the counter. The input of gate 43 connected to the resistor 42 is also connected to earth via a capacitor 62. The resistor 42 and the capacitor 62 cause a delay of the signal at the output Q 11 in order to ensure that the signals of the inputs of gate 43 are both high only at one single predetermined time, viz. the second predetermined time. The ouput of the gate 43 is connected via an inverter 44 to an input of an OR-gate 45, the other input of which is connected to the autoset-device 41. The output of the gate 45 is connected to the SET-input of a flip-flop 46 of the same type as the flip-flop 38 (type 4013 B). Both flip-flops have their D- and RESET-inputs, respectively, connected to earth. A non-inverting input of the flip-flop 46 is connected to the RESET-input of the counter 40 while an inverting input of the flip-flop is connected to the CLOCK-input C of the flip-flop 38. Via a push-button switch 47 and a resistor 48 the CLOCK-input of the flip-flop 46 is connected to a positive supply voltage. Clock pulses are supplied to the CLOCK-input C of the counter 40 via a conductor 49 from a conductor 50 connected to the motor 15 and two current limiting resistors 51,52.

The motor 15 and the various electronic functional elements of FIG. 3 are supplied from the mains via terminal 53,54 and a mains switch 55. In order to be protected against interference, some of the logical circuits are protected by passive components such as diodes, resistors and capacitors and connected to inputs of the circuits sensitive to interference. Such components have been shown in FIG. 3 but will not be described in detail.

In order for the flip-flops 38 and 46 to operate properly they have to be set when the vacuum cleaner operates in the normal range and the autoset- device 41 serves this purpose. This device comprises a comparator 56, the positive input of which is supplied with a predetermined reference voltage from a voltage divider comprising two resistors 57,58 connected to a positive supply voltage and to earth. The negative input of the comparator is connected via a resistor 59 to the positive supply voltage and via a capacitor 60 to earth. The ouput of the comparator 56 is connected to a buffer 61 constituting the output of the autoset-device.

The autoset-device serves the function that, upon operation of the mains switch 55 to ON-condition, the voltage at the positive input of the comparator will rise more rapidly than the corresponding voltage at the negative input. As long as this condition prevails, as a result the output of the comparator will be high as will the outputs of the buffer 61 and the OR-gate 45, respectively. This means that the flip-flop 46, directly, and the flip-flop 38 via the OR-gate 39, will receive the required SET-signal.

The arrangement of FIG. 3 operates in the following manner. Upon operation of the mains switch 55 to ON-condition, as described, flip-flops 38 and 46 will receive a SET-signal from the auto-device during a short initiating period of time which ends when the voltage at the negative input of the comparator 56 equals the voltage at the positive input. At this instant the output of the comparator goes low resulting in the ceasing of the application of the SET-signal to the flip-flops. The flip-flops are of a type which remains in the SET-condition even after the cessation of the SET-signal. The output of the flip-flop 46 connected to the counter 40 is high after the flip-flop has been set and the counter takes a high level at its RESET-input disabling the counter. When the flip-flop 46 is being set the other output of the flip-flop goes low and the CLOCK-input of the flip-flop 38 takes a low level. This has no influence on the flip-flop 38 which will remain in its set condition in which its non-inverting input has a high level. Then the first control signal to the input 20 of the control circuit 36 will be a positive d.c. voltage, the level of which being adjustable by the potentiometer 17. Now, the vacuum cleaner will operate in its normal speed range.

Then, if there is a desire for a temporary additional increase of the suction power the switch 47 is operated to ON-position and the CLOCK- input C of the flip-flop 46 will assume a high level. This means that the information at the data input D will be transferred to the outputs. Since the date input D is permanently at low level the non-inverting output will go low whereas the inverting output goes high. As a result the CLOCK-input of the flip-flop 38 will go high and as in the flip-flop 46 the non-inverting input will go low and, accordingly, the first control signal will be zero. Hence, the second signal at the input 21 of the circuit 36 can act and the circuit will operate the triac 35 to a condition of full excursion and the motor will be driven at the increased speed.

Simultaneously with the motor being controlled to the condition of increased speed, the counter 40 will get a start signal by the level of the RESET-input going low. When the counter has reached a count value corresponding to the first predetermined time, the output Q will go high. This causes the output of gate 39 to go high, setting the flip-flop 38. The output of flip-flop 38 will then again go high and the vacuum cleaner will revert to operte at the speed set by the potentiometer 17. However, the counter will continue to count and upon the second predetermined time being reached both outputs Q 10 and Q 11 will go high. Then, the gate 43 will be set and its output will go low. This signal is inverted by the inverter 44 causing a high signal level at one input of the OR-gate 45. As a result a SET-signal will be applied to the flip-flop 46. Then, the non-inverting output goes high whereas the inverting output goes low resetting the counter and again causing a low level at the CLOCK-input of the flip-flop 38. Accordingly, the conditions that prevailed before the switching in of the increased speed have been reestablished.

I claim:

1. In a vacuum cleaner arrangement having an electric motor, a suction fan connected to the motor, and an electronic speed control device for controlling the motor for the adjustment of the suction power of the vacuum cleaner, said motor having a maximum power for continuous operation, the improvement wherein the speed control device comprises means for permitting adjustment of the motor within a speed range limited at its upper end to a value corresponding to the maximum motor power for continuous operation, the control device further comprising control means for controlling the motor to rotate at a speed corresponding to a power level exceeding said maximum power for a first predetermined period of time and then to return to the speed of rotation at which the motor was operating immediately preceding said first predetermined period of time, and means for inhibiting the operation of said motor at speeds corresponding to a power level exceeding said maximum power during a second predetermined period of time immediately following the first predetermined period of time.

2. The arrangement of claim 1, wherein the electronic control device comprises an electronic switch for connecting the motor to a supply of an a.c. voltage having first and second half cycles, the control device being arranged to connect the motor to the supply voltage during the part of each half cycle of said supply voltage that corresponds to the speed corresponding to the maximum power for continuous operation and to keep the motor connected to said supply during the full said half cycle of said supply voltage during said first predetermined period of time.

3. The arrangement of claim 2, wherein the speed control device includes a control circuit having a first input, a second input and an output, first control means being arranged to apply to the first input a first control signal corresponding to the maximum power for continuous operation within the limited speed range, and second control means connected to apply to the second input a second control signal corresponding to the speed related to the exceeding power level, the control circuit being connectd so that the first control signal dominates over the second control signal when the first control signal has a given level.

4. The arrangement of claim 3, wherein the speed control device comprises a logical circuit responsive to the operation of the control means to set the first control signal to a second value at which the second control signal dominates over the first control signal.

5. The arrangement of claim 4, wherein the logical circuit is responsive to operation of the control means to emit a start signal for a counter, said counter being connected to emit a reset signal after the first predetermined period of time to reset the first control signal to said given level.

6. The arrangement of claim 5, wherein the logical circuit comprises a flip-flop connected both to a circuit comprising the control means and to the counter, the flip-flop having a first state that inactivates the counter and being responsive to operation of the control means to change its state to provide a start signal for the counter.

7. The arrangement of claim 6, wherein the flip-flop is connected to remain in the state in which the start signal is emitted during both the first and the second predetermined periods of time, the counter being responsive to the start of the second predetermined time to emit a signal which operates the flip-flop to again inactivate the counter.

* * * * *